US009109325B2

(12) United States Patent
Yeazell

(10) Patent No.: US 9,109,325 B2
(45) **Date of Patent: *Aug. 18, 2015**

(54) BAGLESS DRY CLEANING KITS AND PROCESSES FOR DRY CLEANING

(76) Inventor: Bruce Albert Yeazell, Cincinnati, OH (US)

( * ) Notice: Subject to any disclaimer, the term of this patent is extended or adjusted under 35 U.S.C. 154(b) by 2545 days.

This patent is subject to a terminal disclaimer.

(21) Appl. No.: 09/811,875

(22) Filed: Mar. 19, 2001

(65) Prior Publication Data

US 2001/0022007 A1 Sep. 20, 2001

Related U.S. Application Data

(63) Continuation of application No. 09/486,411, filed as application No. PCT/IB98/01282 on Aug. 19, 1998, now Pat. No. 6,243,969.

(60) Provisional application No. 60/057,580, filed on Aug. 27, 1997.

(51) Int. Cl.

| | |
|---|---|
| ***D06L 1/02*** | (2006.01) |
| ***C11D 3/20*** | (2006.01) |
| ***D06F 43/00*** | (2006.01) |

(52) U.S. Cl.

CPC ..... *D06L 1/02* (2013.01); *C11D 3/2068* (2013.01); *D06F 43/00* (2013.01)

(58) Field of Classification Search

CPC ..... C11D 3/2068; D06F 58/203; D06F 43/00; D06L 1/02

USPC ..... 34/331, 337, 340, 348, 351, 60, 61, 34/595, 596; 510/439, 291, 293, 295; 8/137, 142, 158, 159

See application file for complete search history.

(56) References Cited

U.S. PATENT DOCUMENTS

| | | | | |
|---|---|---|---|---|
| 3,273,256 | A * | 9/1966 | Behrens | 34/546 |
| 4,473,611 | A | 9/1984 | Haq | |
| 5,238,587 | A * | 8/1993 | Smith et al. | 510/291 |
| 5,630,848 | A | 5/1997 | Young et al. | |
| 5,632,780 | A | 5/1997 | Siklosi | |
| 5,681,355 | A | 10/1997 | Davis et al. | |
| 5,687,591 | A | 11/1997 | Siklosi et al. | |
| 5,746,776 | A | 5/1998 | Smith et al. | |
| 5,762,648 | A | 6/1998 | Yeazell | |
| 5,789,368 | A * | 8/1998 | You et al. | 510/293 |
| 5,804,548 | A | 9/1998 | Davis | |
| 5,876,462 | A * | 3/1999 | Weller et al. | 510/295 |
| 6,243,969 | B1 * | 6/2001 | Yeazell | 34/340 |

FOREIGN PATENT DOCUMENTS

| | | |
|---|---|---|
| WO | WO 97/00991 | 1/1997 |

OTHER PUBLICATIONS

International Search Report for International Application Serial No. PCT/IB98/01282, mailed Nov. 17, 1998, 7 pages.

* cited by examiner

*Primary Examiner* — Jiping Lu

(57) ABSTRACT

A process for dry cleaning fabrics comprising the steps of: (i) placing one or more fabrics to be cleaned in a device which provides heat and agitation; (ii) placing one or more carrier sheets in the device wherein the carrier sheets have about 200 grams of a liquid cleaning/refreshment composition releasably absorbed therein; (iii) heating the air within the device to at least about 130° F. (55° C.); and (iv) agitating the fabrics and the carrier sheets until at least about 40% by weight of the liquid cleaning/refreshment composition from the carrier sheets has been evaporated and vented from the device. There is further provided a kit for dry cleaning fabrics comprising: one or more carrier sheets; and from about 200 grams to about 1,000 grams of a liquid cleaning/refreshment composition, wherein the one or more carrier sheets can absorb at least about 200 grams of the liquid cleaning/refreshment composition.

11 Claims, No Drawings

BAGLESS DRY CLEANING KITS AND PROCESSES FOR DRY CLEANING

This application is a continuation application under 35 USC 120 of U.S. Ser. No. 09/486,411 filed Feb. 25, 2000, which is a 371 application of PCT/IB98/01282 filed Aug. 19, 1998, which claims priority under 35 USC 119(e) to U.S. Ser. No. 60/057,580 filed Aug. 27, 1997.

FIELD OF THE INVENTION

The present invention relates to bagless dry cleaning kits comprising one or more carrier sheets and a liquid cleaning/refreshment composition. Optionally, the kits comprise a stain removal composition and an Absorbent Stain Receiving Article. The present invention further comprises processes for dry cleaning fabric articles and the like with out the need for a containment bag.

BACKGROUND OF THE INVENTION

By classical definition, the term "dry cleaning" has been used to describe processes for cleaning textiles using non-aqueous solvents. Dry cleaning is an old art, with solvent cleaning first being recorded in the United Kingdom in the 1860's. Typically, dry cleaning processes are used with garments such as woolens which are subject to shrinkage in aqueous laundering baths, or which are judged to be too valuable or too delicate to subject to aqueous laundering processes. Various hydrocarbon and halocarbon solvents have traditionally been used in immersion dry cleaning processes, and the need to handle and reclaim such solvents has mainly restricted the practice of conventional dry cleaning to commercial establishments. In addition to the cleaning function, dry cleaning also provides important "refreshment" benefits. For example, dry cleaning removes undesirable odors and extraneous matter such as hair and lint from garments, which are then generally folded or pressed to remove wrinkles and restore their original shape.

One type of home dry cleaning system comprises a carrier sheet containing various cleaning agents, and a plastic bag. The bag can be either sealed such that it is substantially air tight or the bag can be vapor venting. The garments to be cleaned are sealed in the bag together with the sheet, and then tumbled in a conventional clothes dryer. In a commercial embodiment, multiple single-use flat sheets and a single multi-use plastic bag are provided in a package. However, the bag requires storage between uses and it can substantially increase the cost of the dry cleaning kit. Moreover, the bag restricts the number/volume of articles which can be dry cleaned.

It has been the belief in the dry cleaning industry that a containment bag was necessary for dry cleaning fabric articles in a conventional clothes dryer because of the high rate of air flow through conventional dryers. The bag served to contain the water vapor, which evaporates off of the carrier sheets due to the heat in the clothes dryer, so that the water vapor could remain in contact with the fabric articles/garments being dry cleaned thereby delivering perfume and other beneficial agents. It was believed that without a bag the evaporated water vapor would be driven off by the forced air flow in the clothes dryer, prematurely drying the fabric articles before the cleaning/refreshment function was complete.

Hence there is a need for a dry cleaning process which eliminates the containment bag while simultaneously providing the same cleaning, refreshment and garment protection functions of prior dry cleaning processes. Additionally, there is the need for a dry cleaning kit which provides the necessary items and compositions to accomplish the dry cleaning processes described herein.

BACKGROUND ART

Dry cleaning processes are disclosed in: U.S. Pat. No. 5,547,476 issued Aug. 8, 1996 to Siklosi & Roetker; U.S. Pat. No. 5,591,236 issued Jan. 7, 1997 to Roetker; U.S. Pat. No. 5,630,847 issued May 5, 1997 to Roetker; U.S. Pat. No. 5,630,848 issued May 20, 1997 to Young, et al.; U.S. Pat. No. 5,632,780 issued May 27, 1997 to Siklosi; EP application 429,172A1, published May 5, 1991, Leigh, et al.; and in U.S. Pat. No. 5,238,587, issued Aug. 24, 1993, Smith, et al. Other references relating to dry cleaning compositions and processes, as well as wrinkle treatments for fabric articles, include: GB patent 1,598,911; and U.S. Pat. Nos. 4,126,563, 3,949,137, 3,593,544, 3,647,354; 3,432,253 and 1,747,324; and German applications 2,021,561 and 2,460,239, 0,208, 989 and 4,007,362.

Carrier sheet substrates for use in a laundry dryer are disclosed in Canadian patent No. 1,005,204. U.S. Pat. Nos. 3,956,556 and 4,007,300 relate to perforated sheets for fabric conditioning in a clothes dryer. Additionally, U.S. Pat. No. 4,692,277 discloses the use of 1,2-octanediol in liquid cleaners. See also U.S. Pat. Nos. 3,591,510; 3,737,387; 3,764,544; 3,882,038; 3,907,496; 4,097,397; 4,102,824; 4,336,024; 4,606,842; 4,758,641; 4,797,310; 4,802,997; 4,943,392; 4,966,724; 4,983,317; 5,004,557; 5,062,973; 5,080,822; 5,173,200; EP 0 213 500; EP 0 261 718; G. B. 1,397,475; WO91/09104; WO91/13145; WO 93/25654 and Hunt, D. G. and N. H. Morris, "PnB and DPnB Glycol Ethers", HAPPI, April 1989, pp. 78-82.

Absorbent Stain Receiver Articles are preferably made from certain types of "TBAL" structures which are disclosed in U.S. Pat. No. 4,640,810, issued Feb. 3, 1987 to H. Laursen, et al. Use of such structures in diapers and feminine hygiene products is disclosed, for example, in U.S. Pat. No. 5,264,268 issued Nov. 23, 1993 to Luceri, et al.; U.S. Pat. No. 5,364,382 issued Nov. 15, 1994 to Latimer, et al.; U.S. Pat. No. 5,525,407 issued to Yang on Jun. 11, 1996; U.S. Pat. No. 5,569,226 issued Oct. 29, 1996 to Cohen, et al.; U.S. Pat. No. 4,578,070 issued Mar. 25, 1996 to Holtman; U.S. Pat. No. 3,375,827 issued Apr. 2, 1968 to Bletzinger; and U.S. Pat. No. 4,798,603 issued Jan. 17, 1989 to Meyer, et al.

Cleaning/pre-treating compositions and methods are also disclosed, for example, in U.S. Pat. Nos. 5,102,573; 5,041,230; 4,909,962; 4,115,061; 4,886,615; 4,139,475; 4,849,257; 5,112,358; 4,659,496; 4,806,254; 5,213,624; 4,130,392; and 4,395,261.

SUMMARY OF THE INVENTION

The present invention encompasses a bagless dry cleaning kit and process for dry cleaning fabric articles and the like. In one embodiment of the present invention a kit for dry cleaning fabric articles and the like is provided wherein the kit comprises: one or more carrier sheets; and from about 200 grams to about 1,000 grams of a liquid cleaning/refreshment composition; wherein the one or more carrier sheets can absorb at least about 200 grams of the liquid cleaning/refreshment composition. In a preferred embodiment of the present invention the kit further comprises an Absorbent Stain Receiver Article and a pre-treating composition.

In another aspect, the invention provides a process for dry cleaning fabric articles and the like, wherein the process comprises the steps of:

(i) placing one or more fabric articles to be cleaned in a device which provides heat and agitation;

(ii) placing one or more carrier sheets in the device wherein the carrier sheets have about 200 grams of a liquid cleaning/refreshment composition releasably absorbed therein;

(iii) heating the air within the device to at least about 100° F. (37.8° C.); and (iv) agitating the fabric articles and the carrier sheets until at least about 40% by weight of the liquid cleaning/refreshment composition from the carrier sheets has been evaporated and vented from the device.

In a preferred aspect, for treating garments with localized stains, a process of the present invention further comprises the steps of:

(i) placing a localized stained area of the fabric article over and in contact with an Absorbent Stain Receiver Article;

(ii) applying enough pre-treating composition to the fabric article to saturate the localized stained area;

(iii) allowing the composition to penetrate the stain for a predetermined period of time; and (iv) removing the fabric article from contact with the Absorbent Stain Receiver Article.

The kits and methods of the present invention provide the convenience and economic advantages of a home dry cleaning system while simultaneously eliminating the need for a cumbersome, expensive and restrictive bag. It has surprisingly been found that through the proper selection and sizing of the carrier sheet—such that it can supply the proper amount of liquid cleaning/refreshment composition to the clothes dryer and the fabric articles to be dry cleaned—the bag of prior dry cleaning processes can be eliminated. Moreover, the entire volume of a conventional clothes dryer can be utilized for dry cleaning fabric articles and the like using the kits and processes of the present invention. Additionally, by adding a sufficient quantity of the liquid cleaning/refreshment composition to the clothes dryer the fabric articles to be dry cleaned can be cleaned without adding new wrinkles to the fabric articles. Moreover, preexisting wrinkles in fabrics can be removed by using the kits and dry cleaning processes of the present invention.

DETAILED DESCRIPTION OF THE INVENTION

It has now been discovered that liquid cleaning/refreshment compositions can be loaded onto a carrier substrate, or "carrier sheet", such as a cloth or woven or non-woven towelette and placed in a heated clothes dryer, or the like, to remove malodors from fabric articles as a dry cleaning alternative or "fabric refreshment" process. The warm, humid environment created inside the clothes dryer, or other drying device capable of providing a heated environment while simultaneously agitating the fabric articles to be dry cleaned, volatilizes malodor components in the manner of a "steam distillation" process, while moistening fabrics and the soils thereon. This moistening of fabrics can loosen pre-set wrinkles, but it has now been discovered that overly wet fabric articles can experience setting of new wrinkles during the drying stage toward the end of the dryer cycle. Proper selection of the amount of liquid cleaning/refreshment composition used in the process and, importantly, proper venting of the drying device in the present manner can minimize wrinkling. Moreover, if the drying device is not sufficiently vented, the volatilized malodorous materials removed from the fabric articles can undesirably be re-deposited thereon.

The amount or liquid cleaning/refreshment composition utilized, the temperature of the dryer operation, the amount of airflow through the drying device and the amount of time the fabric articles being dry cleaned are agitated all play an important role in the dry cleaning processes described herein. For example, adding too much liquid cleaning/refreshment composition to the drying device will overly moisten the fabric articles, resulting in wrinkling. Likewise adding too small an amount of liquid cleaning/refreshment composition to the drying device will not sufficiently moisten the fabric articles or soils to mobilize malodors or to remove pre-existing fabric wrinkles. Further, operating the drying device at too high of a temperature and/or at too high of an air flow rate will tend to volatilize and drive off the liquid cleaning/refreshment composition before the desired cleaning/refreshment benefits are achieved.

As can be appreciated, the objective herein is to operate within the region which minimizes the formation of new wrinkles and removes wrinkles which are already present in the garments prior to treatment. Moreover, with respect to malodor, it is preferred to deliver sufficient liquid cleaning/refreshment composition (grams of liquid cleaning/refreshment composition on substrate) to achieve substantial malodor removal.

In practice, this means that the dry cleaning processes described herein, which operate without a containment bag of prior dry cleaning systems, requires that a substantially greater amount of liquid cleaning/refreshment composition be added to the fabric articles to be dry cleaned. Satisfactory results can be obtained by adding from about 200 to about 1,000 grams of liquid cleaning/refreshment composition. Less liquid can be used, but wrinkles will not be efficiently removed from the fabric articles and malodor removal will suffer. Too much liquid, e.g., more than about 1,000 grams, will cause additional wrinkles to begin to form in the fabric articles.

Optionally, to reduce the amount of liquid cleaning/refreshment composition that must be added to the drying device while maintaining the desired cleaning/refreshment benefits described herein, the amount of air flow through the drying device can be regulated. For example, reducing the air flow rate through the drying device necessarily reduces the amount of liquid cleaning/refreshment composition that is removed/vented from therewithin. Hence, the liquid cleaning/refreshment composition will have a longer residence time within the dryer and subsequently a lesser amount of liquid cleaning/refreshment composition will be necessary. Air flow through the drying device can be regulated/restricted by any number of ways known to those skilled in the art. Specifically, a simple butterfly-valve in the vent line can regulate the amount of air flow through the dryer, as will any other method of partially blocking the dryer vent line. Adjusting the fan speed is another alternative and others will be apparent to those skilled in the art.

The necessary amount of liquid cleaning/refreshment composition can also be reduced by recycling some or most of the dryer exhaust air back into the dryer inlet air stream, thereby retaining the moisture vented from the dryer and reducing the evaporation rate from the carrier substrate. This type of dryer operation is currently used in certain "condensation" type dryers which are used commercially in Europe. The liquid demand can be further reduced by eliminating or by-passing the condenser commonly used on the recycle stream of condensation type dryers.

With regard to these considerations, it has been observed that the carrier sheets, which are discussed in greater detail below, should not be so saturated with the liquid compositions herein that they are "dripping" wet. If excessively wet ("dripping"), localized water transfer to the fabric articles being cleaned and refreshed can cause wrinkling. While it might have been thought that a larger carrier substrate could be used to provide more liquid capacity, this can be self-limiting. Carrier sheets which are too large can become entangled with the fabric articles being cleaned/refreshed, again resulting in excessive localized wetting of the fabric articles. Hence, if it is desired to add more liquid cleaning/refreshment composition to the dryer device it is often preferred to add more than one carrier sheet rather than increasing the size of the sheet. Accordingly, while the carrier sheets used herein are optimal for the dryer sizes as noted, their sizes can, without undue experimentation, be adjusted proportionately for larger and smaller dryer drum capacities. To achieve the desired cleaning/refreshment benefits the present invention requires one or more carrier sheets, and from about 200 grams to about 1,000 grams of a liquid cleaning/refreshment composition. Additionally, the one or more carrier sheets should be capable of absorbing at least about 200 grams of the liquid cleaning/refreshment composition.

The fabric articles, when removed from the dryer, will usually contain a certain amount of additional moisture. This will vary by fabric type. For example, silk treated in the optimal range of liquid cleaning/refreshment composition may contain from about 0.5% to about 2.5%, by weight, of added moisture. Wool may contain from up to about 4%, by weight, of added moisture. Rayon also may contain up to about 4% by weight, of added moisture. This is not to say that the fabric articles are, necessarily, frankly "damp" to the touch. Rather, the fabric articles may feel cool, or cool-damp due to evaporative water losses. The fabric articles thus secured may be hung to further air dry, thereby preventing wrinkles from being re-established. If desired, the fabric articles can be ironed or subjected to other finishing processes, according to the desires of the user.

The following is intended to assist the formulator in the manufacture and use of kits and processes of this invention, but is not intended to be limiting thereof.

Vapor Venting Evaluation

In their broadest sense, the processes of this invention are designed to be able to vent from at least about 40% to at least about 99% by weight, and preferably from at least about 60% to at least about 90% by weight, of the total moisture introduced into the drying device or other hot air apparatus during the operating cycle. "Operating cycle" as used herein means the amount of time required to vent off the desired amount of moisture in the drying device. Of course most, if not all, of the organic cleaning solvents will also be vented together with the water. However, since water comprises the major portion of the liquid cleaning/refreshment compositions herein, it is more convenient to measure and report the venting as water vapor venting.

Determining the percent of moisture remaining in the dryer, which subsequently determines the end point of the operating cycle, can be accomplished by a variety of analytical tools known to the art. For example, as the fabric articles within a conventional clothes dryer begin to dry, the temperature within the dryer begins to rise. When the temperature rises above a set-point the clothes are considered dry. The set-point can be adjusted to end the drying cycle at the desired moisture level as discussed above. There are other, more accurate, methods for determining water vapor content which are currently available on conventional clothes dryers. Specifically, many dryers now employ a system of two metal strips permanently affixed to a non-rotating dryer wall. As clothes pass over these strips moisture from the clothes is deposited thereupon. The moisture bridges a gap between the two strip thereby completing an electrical circuit which can be electronically detected. As the clothes become dryer, the circuit is completed less frequently. Hence, the percent of moisture remaining on the fabric articles being cleaned can be accurately determined and the operating cycle time adjusted accordingly.

It will be appreciated by those knowledgeable about the operation of current hot air clothes dryers and similar apparatus that the rate of venting will usually not be constant over the entire operating cycle. All dryers have a warm-up period at the beginning of the operating cycle, and this can vary according to the specifications of the manufacturer. Most dryers have a cool-down period at the end of the operating cycle. Some venting from the drying device can occur during these warm-up and cool-down periods, but its rate is generally less than the venting rate over the main period of the drying cycle. Moreover, even during the main period of the cycle, many modern dryers are constructed with thermostat settings which cause the air temperature in the dryer to be increased and decreased periodically, thereby preventing overheating. Thus, an average, rather than constant, dryer operating temperature in the target range of from about 50° C. to about 85° C. is typically achieved. However, a dryer could be designed which utilizes the dry cleaning kits and processes of the present invention and which operates at lower temperatures such as from about 40° C. to about 70° C.

Moreover, the user of the present kits and processes may choose to stop the operation of the drying device before the cycle has been completed. Some users may wish to secure fabric articles which are still slightly damp so that they can be readily ironed, hung up to dry, or subjected to other finishing operations.

Apart from the time period employed, the percent of total moisture vented for any given type of drying device will depend mainly on the temperature achieved within the dryer—which, as noted above, is typically reported as an average "dryer air temperature". In point of fact, due to the tumbling action afforded by conventional clothes dryers, it is a reasonable approximation to measure the percent of moisture vented with reference to the average dryer air temperature.

Moreover, it will be appreciated that the vapor-venting from the drying device should not be so rapid that the liquid cleaning/refreshment composition does not have the opportunity to moisten the fabric articles being treated and to mobilize and remove the soils/malodors therefrom. Indeed, the preferred processes are designed to prevent premature venting, thereby allowing the liquid and vapors of the cleaning/refreshment composition to remain within the drying device for a period which is sufficiently long to perform its intended functions on the fabric articles being treated.

Carrier Sheets

Carrier sheets are used to conveniently transport the liquid cleaning/refreshment composition defined below to the drying device such that the compositions perform their function. The carrier sheets releasably contain the compositions. "Releasably contains" means that the compositions are effectively released from the carrier as they are evaporated in the heated environment of the drying device and to a lesser extent by physical contact with the fabric articles being cleaned.

The carrier can be in any desired form, such as powders, flakes, shreds, and the like. However, it will be appreciated that such comminuted carriers would have to be separated from the fabric articles at the end of the process. Accordingly, it is highly preferred that the carrier be in the form of an integral pad or sheet which substantially maintains its structural integrity throughout the process. Such pads or sheets can be prepared, for example, using well-known methods for manufacturing non-woven sheets, paper towels, fibrous batts, cores for bandages, diapers and catamenials, and the like, using materials such as wood pulp, cotton, rayon, polyester fibers, and mixtures thereof. Woven cloth pads may also be used, but are not preferred over non-woven pads due to cost considerations. Integral carrier pads or sheets may also be prepared from natural or synthetic sponges, foams, and the like.

The carriers are designed to be safe and effective under the intended operating conditions of the present process. The carriers must not be flammable during the process, nor should they deleteriously interact with the cleaning or refreshment composition or with the fabric articles being cleaned. In general, non-woven polyester-based pads or sheets are quite suitable for use as the carrier herein.

The carrier used herein is most preferably non-linting. "Non-linting" herein means a carrier which resists the shedding of visible fibers or microfibers onto the fabric articles being cleaned, i.e., the deposition of what is known in common parlance as "lint". A carrier can easily and adequately be judged for its acceptability with respect to its non-linting qualities by rubbing it on a piece of dark blue woolen cloth and visually inspecting the cloth for lint residues.

The non-linting qualities of sheet or pad carriers used herein can be achieved by several means, including but not limited to: preparing the carrier from a single strand of fiber; employing known bonding techniques commonly used with nonwoven materials, e.g., point bonding, print bonding, adhesive/resin saturation bonding, adhesive/resin spray bonding, stitch bonding and bonding with binder fibers. In an alternate mode, a carrier can be prepared using an absorbent core, said core being made from a material which, itself, sheds lint. The core is then enveloped within a sheet of porous, non-linting material having a pore size which allows passage of the cleaning or refreshment compositions, but through which lint from the core cannot pass. An example of such a carrier comprises a cellulose or polyester fiber core enveloped in a non-woven polyester scrim.

The carrier should be of a size which provides sufficient surface area that it permits the rapid evaporation of water and other ingredients as discussed herein, e.g. perfume. Of course, the size of the carrier should not be so large as to be unhandy for the user. Typically, the dimensions of the carrier will be sufficient to provide a macroscopic surface area (both sides of the carrier) of at least about wherein the one or more carrier sheets have an aggregate surface area of from about 250 $in^2$ (1,613 $cm^2$) to about 6,000 $in^2$ (38,710 $cm^2$) and/or from about have the dimensions (X-direction) of from about 40 cm to about 80 cm, and (Y-direction) of from about 40 cm to about 80 cm. Two or more smaller carrier sheets can be used when a larger surface area is desired (or needed) as is discussed above.

The carrier is intended to contain a sufficient amount of the liquid cleaning/refreshment composition to be effective for the intended purpose. The capacity of the carrier for such compositions will vary according to the intended usage. For example, pads or sheets which are intended for a single use will require less capacity than such pads or sheets which are intended for multiple uses. For a given type of carrier the capacity for the cleaning or refreshment composition will vary mainly with the thickness or "caliper" (Z-direction; dry basis) of the sheet or pad. For purposes of illustration, typical single-use polyester sheets used herein will have a thickness in the range from about 0.1 mm to about 0.7 mm and a basis weight in the range from about 30 $g/m^2$ to about 100 $g/m^2$. Typical multi-use polyester pads herein will have a thickness in the range from about 0.2 mm to about 1.0 mm and a basis weight in the range from about 40 $g/m^2$ to about 150 $g/m^2$. Open-cell sponge sheets will range in thickness from about 0.1 mm to about 1.0 mm. Of course, the foregoing dimensions may vary, as long as the desired quantity of the cleaning or refreshment composition is effectively provided by means of the carrier.

A preferred carrier herein comprises a binderless (or optional low binder), hydroentangled absorbent material, especially a material which is formulated from a blend of cellulosic, rayon, polyester and optional bicomponent fibers. Such materials are available from Dexter, Non-Wovens Division, The Dexter Corporation as HYDRASPUN®, especially Grade 10244 and 10444. The manufacture of such materials forms no part of this invention and is already disclosed in the literature. See, for example, U.S. Pat. No. 5,009,747, Viazmensky, et al., Apr. 23, 1991 and U.S. Pat. No. 5,292,581, Viazmensky, et al., Mar. 8, 1994, incorporated herein by reference.

As an entirely optional matter, the carrier sheet can also have holes punched therethrough in order to further maximize its ability to maintain an open configuration in-use. Indeed, the holes can be punched through the entire article, including the coversheet, itself. For an article having the overall dimensions of about 40 cm×40 cm, 20 round holes, each about 0.5 in. (1.27 cm) in diameter are evenly spaced across the HYDRASPUN® carrier sheet. Slits or other perforations may be used in like manner.

Preferred materials for use herein have the following physical properties.

| Dexter Corp. Grade 10244 | | | |
|---|---|---|---|
| | Units | Targets | Range |
| Basis Weight | $gm/m^2$ | 55 | 35-75 |
| Thickness | microns | 355 | 100-1500 |
| Density | gm/cc | 0.155 | 0.1-0.25 |
| Dry Tensile | gm/25 mm | | |
| MD | | 1700 | 400-2500 |
| CD | | 650 | 100-500 |
| Wet Tensile | gm/25 mm | | |
| MD* | | 700 | 200-1250 |
| CD* | | 300 | 100-500 |
| Brightness | % | 80 | 60-90 |
| Absorption Capacity | % | 735 | 400-900 ($H_2O$) |
| Dry Mullen | $gm/cm^2$ | 1050 | 700-1200 |

*MD-achine direction; CD-ross direction

As disclosed in U.S. Pat. Nos. 5,009,747 and 5,292,281, the hydroentangling process provides a nonwoven material suitable for use as a carrier sheet which comprises cellulosic fibers, and preferably at least about 5% by weight of synthetic fibers, and requires less than 2% wet strength agent to achieve improved wet strength and wet toughness. Surprisingly, this hydroentangled carrier is not merely a passive absorbent for the cleaning and/or refreshment compositions herein, but actually optimizes cleaning performance. While not intending to be limited by theory, it may be speculated that this carrier is more effective in delivering the compositions to soiled fabrics. Or, this particular carrier might be better for removing soils by contact with the soiled fabrics, due to its mixture of fibers. Whatever the reason, improved dry cleaning performance is secured.

In addition to the improved performance, it has now been discovered that this hydroentangled carrier material provides an additional, unexpected benefit due to its resiliency. In-use, the sheets herein are designed to function in a substantially open configuration. However, the sheets may be packaged and sold to the consumer in a folded configuration. It has been discovered that carrier sheets made from conventional materials tend to undesirably revert to their folded configuration in-use. This undesirable attribute can be overcome by perforating such sheet, but this requires an additional processing step. It has now been discovered that the hydroentangled materials used to form the carrier sheet herein do not tend to re-fold during use, and thus do not require such perforations (although, of course, perforations may be used, if desired). Accordingly, this attribute of the hydroentangled carrier materials herein makes them optimal for use in the manner of the present invention.

Controlled Release Carriers

Other carriers which can be used in the present invention are characterized by their ability to absorb liquid cleaning compositions, and to release them in a controlled manner. Such carriers can be single-layered or multi-layer laminates. In one embodiment, such controlled-release carriers can comprise the absorbent core materials disclosed in U.S. Pat. No. 5,009,653, issued Apr. 23, 1991, to T. W. Osborn III, entitled "Thin, Flexible Sanitary Napkin", assigned to The Procter & Gamble Company, incorporated herein by reference.

Another specific example of a controlled-release carrier herein comprises a hydroentangled web of fibers (as disclosed above) having particles of polymeric gelling materials dispersed, either uniformly or non-uniformly, in the web. Suitable gelling materials include those disclosed in detail at columns 5 and 6 of Osborn, as well as those disclosed in U.S. Pat. No. 4,654,039, issued Mar. 31, 1987, to Brandt, Goldman and Inglin. Other carriers useful herein include WATER-LOCK® L-535, available from the Grain Processing Corporation of Muscatin, Iowa. Non-particulate superabsorbents such as the acrylate fibrous material available under the tradename LANSEAL F from the Choli Company of Higashi, Osaka, Japan and the carboxymethylcellulose fibrous material available under the tradename AQUALON C from Hercules, Inc., of Wilmington, Del. can also be used herein. These fibrous superabsorbents are also convenient for use in a hydro-entangled-type web.

In another embodiment, the controlled release carrier can comprise absorbent batts of cellulosic fibers or multiple layers of hydroentangled fibers, such as the HYDRASPUN sheets noted above. In this embodiment, usually 2 to about 5 sheets of HYDRASPUN, which can optionally be spot-bonded or spot-glued to provide a coherent multi-layered structure, provides an absorbent carrier for use herein without the need for absorbent gelling materials, although such gelling materials can be used, if desired. Other useful controlled release carriers include natural or synthetic sponges, especially open-cell polyurethane sponges and/or foams. Whatever controlled release carrier is selected, it should be one which imbibes the liquid cleaning compositions herein thoroughly, yet releases them with the application of pressure or heat. Typically, the controlled release carriers herein will feel wet or, preferably, somewhat damp-to-nearly dry to the touch, and will not be dripping wet when carrying 200-1,000 grams of the liquid cleaning/refreshment composition.

Coversheet

Coversheets which are optionally, but preferably, employed herein to enrobe the carrier sheet are distinguished from the carrier substrate sheets, inasmuch as the coversheets are relatively non-absorbent to the liquid cleaning/refreshment compositions as compared with the carrier sheets. The coversheets are constructed from hydrophobic fibers which tend not to absorb, "wick" or otherwise promote the transfer of fluids. While fluids can pass through the void spaces between the fibers of the coversheet, this occurs mainly when excessive pressure is applied to the article. Thus, under typical usage conditions the coversheet provides a physical barrier which keeps the absorbent carrier, which is damp from its load of liquid cleaning/refreshment composition, from coming into direct contact with the fabric articles being treated. Yet, the permeable coversheet does allow vapor transfer of the cleaning/refreshment composition from the carrier through the coversheet and then onto the fabric articles being treated.

One type of coversheet herein comprises a fibrous, permeable nonwoven or woven fabric. Such nonwoven or woven fibrous coversheets offer advantages over formed-film type coversheets known in the catamenials art. For example, formed-film coversheets (as described hereinafter) are often manufactured by hydroforming processes which are particularly suitable with polymer films such as polyethylene. While polyethylene can be used herein, there is some prospect that, due to its lower melting point, high dryer temperatures can cause its softening and/or melting in-use. While it is possible to prepare formed-film topsheets using nylon, polyester or other heat resistant polymeric sheets, such manufacture becomes somewhat more difficult and, hence, more expensive.

It has now also been determined that the coversheet herein should be of a thickness which effectively provides the physical barrier function. Even though made from hydrophobic fibers, if the coversheet is too thin, fluid passage can occur under the intended usage conditions. Accordingly, it has now been determined that the thickness of the fibrous coversheet should preferably be at least about 7 mils (0.18 mm), preferably from about 0.2 mm to about 0.6 mm. It has also been determined that the fibers used in the coversheet are preferably hydrophobic and preferably have a melting point above about 240° C.

Fibrous coversheets for use herein can readily be made from non-heat resistant fibers such as polyethylene. However, it has now been determined that preferred fibrous coversheets can be prepared using nylon (especially nylon-6), polyester, and the like, heat-resistant fibers which can withstand even inadvertent misuse in the present process. The flexible, cloth-like, permeable topsheets made therefrom are conventional materials in the art of nonwoven and woven fabric making, and their manufacture forms no part of the instant invention. Nonwoven fabrics for use as coversheets are available commercially from companies such as Reemay, Inc., Hickory, Tenn. Such coversheets also pick up solid dust particles, vagrant lint and other fibers from the fabric articles being treated in the present process, thereby enhancing the overall clean/refreshed appearance of the fabric articles following the treatment herein.

Such nonwoven or woven fibrous sheet materials can be used in a flat single layer or as multiple layers as the coversheet for the absorbent carrier core herein. In another embodiment, the absorbent core carrying the cleaning/refreshment composition is enrobed in a polyester or polyamide fibrous coversheet which has been ring rolled or otherwise crimped to provide three dimensional bulk. Optionally, this coversheet may be further covered by a second coversheet in an uncrimped configuration.

Such fibrous, preferably heat resistant and, most preferably, hydrophobic, coversheets thus provide various embodiments of the article herein. Suitable combinations can be employed, according to the desires of the manufacturer, without departing from the spirit and scope of the invention. If desired, the coversheet can be provided with macroscopic fenestrations through which the lint, fibers or particulate soils can pass, thereby further helping to entrap such foreign matter inside the article, itself.

A typical spun-bonded fibrous coversheet herein is commercially available from Reemay and has the following characteristics.

(a) Fabric Type—Non-woven, semi-dull, whitened homopolymer 100% virgin, spun-bonded polyester.

(b) Fiber Type—6.0 Denier straight, tri-lobal continuous fiber, copolymer polyester.

| Web Properties | Target | Range |
|---|---|---|
| a) Basis weight, roll average oz/yd$^2$ | 0.54 | 0.52 to 0.59 |
| b) Thickness | 8 mil | 7 to 8 mil |
| c) Fuzz level As measured by Reemay sled/drag method based on 0-5 scale, 5 being no fuzz level. | | |
| Belt side | 2.5 | 5.0 to 1.8 |
| Jet side | 3.4 | 5.0 to 2.6 |

As noted above, another type of coversheet which can be used with the carrier sheets herein comprises the apertured "formed film" coversheets known in the art and from commercial use on catamenials. Apertured formed films are pervious to the liquid cleaning and/or refreshment compositions and vapors thereof, and yet non-absorbent. Thus, the surface of the formed film which is in contact with the fabric articles remains relatively dry, thereby reducing water spotting and dye transfer. As with the fibrous coversheets, the apertured formed films capture and retain lint, fibrous matter such as pet hair, and the like, from the fabric being treated, thereby enhancing the cleaning/refreshment benefits afforded by the present articles. Suitable formed films are described in U.S. Pat. No. 3,929,135, entitled "Absorptive Structure Having Tapered Capillaries", issued to Thompson on Dec. 30, 1975; U.S. Pat. No. 4,324,246, entitled "Disposable Absorbent Article Having A Stain Resistant Coversheet", issued to Mullane and Smith on Apr. 13, 1982; U.S. Pat. No. 4,342,314, entitled "Resilient Plastic Web Exhibiting Fiber-Like Properties", issued to Radel and Thompson on Aug. 3, 1982; and U.S. Pat. No. 4,463,045, entitled "Macroscopically Expanded Three-Dimensional Plastic Web Exhibiting Non-Glossy Visible Surface and Cloth-Like Tactile Impression", issued to Ahr, Louis, Mullane and Ouellette on Jul. 31, 1984; U.S. Pat. No. 4,637,819 issued to Ouellette, Alcombright & Curro on Jan. 20, 1987; U.S. Pat. No. 4,609,518 issued to Curro, Baird, Gerth, Vernon & Linman on Sep. 2, 1986; U.S. Pat. No. 4,629,642 issued to Kernstock on Dec. 16, 1986; and EPO Pat. No. 0,165,807 of Osborn published Aug. 30, 1989; all of which are incorporated herein by reference. The apertures in such coversheets may be of uniform size or can vary in size, as disclosed in the foregoing published documents, which can be referred to for technical details, manufacturing methods, and the like. Such apertures may also vary in diameter in the manner of so-called "tapered capillaries". Such formed-film cover-sheets with tapered capillary apertures preferably are situated over the carrier sheet such that the smaller end of the capillary faces the carrier sheet and the larger end of the capillary faces outward. This helps prevent bulk liquid transfer, thereby minimizing water spotting on the fabric articles being treated. In the main, apertures in the formed film coversheets used herein can have diameters in the range of from about 0.1 mm to about 1 mm, or as disclosed in the aforesaid patent references.

A carrier sheet of the present type can be assembled as a laminate comprising a topmost fibrous sheet, an absorbent carrier substrate as the core and a bottommost fibrous sheet. The combination of topsheet and bottomsheet comprises the "coversheet" in the preferred embodiment of the articles herein. In one preferred mode, a bond extends around the periphery of the article. The purpose of this bond is to ensure that the absorbent carrier core maintains its original configuration relative to the coversheet when the article is being used in the manner of this invention. Stated simply, it has been discovered that if the absorbent sheet which comprises the core is not bonded to the "envelope" provided by the coversheet in-use, the carrier sheet tends to crumple and bunch-up inside the coversheet. This can interfere with the delivery of the cleaning/refreshment composition to the fabric articles being treated.

Moreover, it has also been discovered that it is not preferred to tightly bond the coversheet to the carrier sheet across the entire face of the carrier sheet. Tightly bonding the coversheet closely to the carrier sheet can allow some liquid transfer to occur through the coversheet. Accordingly, the carrier sheet is bonded to the coversheet only in discrete areas. In one embodiment, this bonding is only around the periphery of the article. In another embodiment, spot-bonding at discrete areas across the face of the article can be employed. Various other bond patterns can be used. Preferably, the bonding is done at no more than about 50% of the area of the article, more preferably no more than about 10% of the area of the article, most preferably no more than about 1% of the area of the article.

Liquid Cleaning/Refreshment Compositions

The liquid cleaning/refreshment compositions of the present invention comprise primarily water and perfume. Often it is desirable, if not necessary to include an emulsifier to maintain the perfume in suspension. The liquid cleaning/refreshment compositions of the present invention can optionally comprise surfactants and/or solvents to enhance the cleaning/refreshment benefits disclosed herein. Preferably, the liquid cleaning/refreshment composition comprises from about 90% to about 99.5% by weight water and from about 10% to about 0.5% by weight of materials selected from the group consisting of perfumes, emulsifiers, surfactants, solvents, preservatives and mixtures thereof. Examples II and III below detail specific compositions that have been used in the processes and kits of the present invention. However, these examples are not intended to limit the present invention.

Preferred refreshment compositions herein are as follows.

| Ingredient | % (wt.) | Range (% wt.) |
|---|---|---|
| Water | 99.0 | 95.1-99.9 |
| Perfume | 0.5 | 0.05-1.5 |
| Surfactant* | 0.5 | 0.05-2.0 |
| Ethanol or Isopropanol | 0 | Optional to 4% |

*Especially preferred ethoxylated alcohols, as discussed in greater detail below. The fabric refreshment compositions may also contain anionic surfactants. Such anionic surfactants are well-known in the detergency arts. Commercial surfactants available as TWEEN ®, SPAN ®, AEROSOL OT ® and various sulfosuccinic esters are especially useful herein.

Perfume

As can be appreciated, the higher molecular weight, high boiling point, malodorous chemicals tend to be retained on the fabric articles, at least to some degree. These malodors can be overcome, or "masked" by perfumes. However, it will be appreciated from the foregoing that the perfumer should select at least some perfume chemicals which are sufficiently high boiling that they are not entirely vented from the drying device along with volatile malodors. A wide variety of aldehydes, ketones, esters, acetals, and the like, perfumery chemicals which have boiling points above about 50° C., preferably above about 85° C., are known. Such ingredients can be delivered by means of the carrier substrate herein to permeate the contents of the drying device during the processes herein, thereby further reducing the user's perception of malodors. It is understood that the perfumes suitable for use in the liquid cleaning/refreshment compositions discussed above are generally suitable for use in the pre-treating compositions discussed below.

Non-limiting examples of perfume materials with relatively high boiling components include various essential oils, resinoids, and resins from a variety of sources including but not limited to orange oil, lemon oil, patchouli, Peru balsam, Olibanum resinoid, styrax, labdanum resin, nutmeg, cassia oil, benzoin resin, coriander, lavandin and lavender. Still other perfume chemicals include phenyl ethyl alcohol, terpineol and mixed pine oil terpenes, linalool, linalyl acetate, geraniol, nerol, 2-(1,1-dimethylethyl)-cyclohexanol acetate, orange terpenes and eugenol. Of course, lower boiling materials can be included, with the understanding that some loss will occur due to venting.

Localized Stain Removal

In a preferred embodiment of the present invention the kits further comprise an Absorbent Stain Receiver Article and a pre-treating composition which are used together to pre-treat localized stained areas of the fabric articles to be dry cleaned. The Absorbent Stain Receiver Article and pre-treating composition are discussed in turn below.

In a preferred mode the pre-treating composition comprises water and a surfactant, preferably a surfactant which comprises a mixture of MgAES surfactant and amine oxide surfactant. The composition also preferably comprises water and a solvent, preferably butoxy propoxy propanol. As an overall consideration, the compositions typically comprise the solvent and at least about 95%, by weight, of water, preferably also comprising a solvent and a surfactant, i.e., water, a solvent and a surfactant.

In a preferred mode the process is conducted by working the composition into the stain by means of mechanical force applied to the stain. In a highly preferred mode, the ASRA is a fibrous TBAL structure. As disclosed hereinafter, the synthetic fiber content of the low capillary pressure zone of the ASRA is preferably higher than the synthetic fiber content of the high capillary pressure zone, and is about 80% to about 100%, preferably about 100%, by weight, of synthetic fiber.

Absorbent Stain Receiver Article ("ASRA")

The ASRA herein can comprise any of a number of absorbent structures which provide a capillary pressure difference through their thickness (Z-direction). When designing the ASRA for use in the spot removal process herein, the following matters are taken into consideration. First, the cleaning solution only removes the soil from the fibers of the fabric even with agitation. If the cleaning solution which carries the soil is allowed to remain in the fabric, the soil will be redeposited on the fabric as the cleaning solution dries. The more complete the removal of cleaning solution from the fabric, the more complete will be the removal of soil.

Second, the fabric article being treated is, itself, basically a fibrous absorbent structure which holds liquid (i.e., the cleaning solution) in capillaries between the fibers. While some liquid may be absorbed into the fibers, most of the liquid will be held in interfiber capillaries (this includes capillaries between filaments twisted into a thread). Liquid held in the fabric may be removed by contacting it with another absorbent structure such as the ASRA, herein. In this process, liquid is transferred from the capillaries of the fabric to the capillaries of the ASRA.

Third, liquid is held in capillaries by capillary pressure. Capillary pressure (Pc) is generally described by the following equation:

$$Pc=(2\times G\times \mathrm{Cos}\ A)/R \text{ where}$$

G=the surface tension of the liquid

A=the contact angle between the liquid and the capillary wall

R=the radius of the capillary

Accordingly, capillary pressure is highest in capillaries which have a low contact angle and a small radius. Liquid is held most tightly by high capillary pressure and will move from areas of low capillary pressure to areas of high capillary pressure. Hence, in the subject ASRA which provides a capillary pressure difference through its thickness, liquid will move from low capillary pressure areas to high capillary pressure areas. Capillary pressure can be measured using a variety of techniques, but will employ the liquid cleaning composition as the test liquid.

In reality, most absorbent materials are complex structures comprised of a range of capillary sizes and contact angles. For this discussion, the capillary pressure of a material or capillary pressure zone within a material is defined as the volumetric weighted average of the range of pressures found within that material or zone.

For purposes of illustration, in circumstances wherein a soiled fabric saturated with cleaning solution is in liquid communication contact with two stacked, identical layers of homogeneous absorbent material, such as a paper towel, solution and soil would readily transfer from the fabric to the towel until the capillary pressure is approximately equal in the two materials. At equilibrium a certain amount of solution and soil will remain in the fabric. The exact amount will depend on the basis weight and capillary pressure characteristics of the fabric and towel. A reduced amount of residual solution and soil in the fabric, and therefore better cleaning, would result from replacing the bottom layer (layer not in direct contact with the fabric) of towel with an absorbent layer of capillary pressure higher than that of the towel. By virtue of its higher capillary pressure this absorbent layer will cause more solution to transfer from the low capillary pressure top towel layer to the high capillary pressure absorbent layer which in turn causes more solution to transfer from the fabric to the top towel layer. The result is better cleaning due to less residual solution and soil remaining in the fabric.

This type of multi-layer system is also beneficial when Z-directional pressure is applied to the wetted stained fabric and ASRA. This pressure compresses the various materials, thereby lowering their void volume and liquid absorption capacity (increasing the % saturation of the materials). This can cause liquid to be squeezed out. The layered structure allows for free liquid to be absorbed by the lower layer, i.e., the one furthest away from the fabric. This lessens the reabsorption of liquid by the fabric. This is especially true if the bottom layer (layer of highest capillary pressure) is also relatively incompressible (retains a higher percentage of its void volume under pressure) compared to the top layer (layer of lower capillary pressure). In this case it may be desirable for the top layer to be resiliently compressible so as to express liquid under pressure which can be absorbed by the bottom layer.

Thus the ASRA can comprise two or more relatively distinct layers which differ in capillary pressure. As can be seen from the capillary pressure equation, a difference in capillary pressure can be achieved by varying the capillary size or the contact angle between the cleaning solution and the ASRA. Both factors can be controlled by the composition of the ASRA. The contact angle portion of the equation can also be affected by chemical treatment of the ASRA with, for example, a surfactant to lower the contact angle or a water repellent material such as silicone to increase contact angle.

The effectiveness of an ASRA comprising multiple layers of differing capillary pressure can be enhanced by locating most of the total absorbent capacity in the high capillary pressure portion. The top fabric facing layer need only be thick enough to insulate the fabric from the liquid held in the bottom layer.

The effectiveness of the layered ASRA can be further enhanced by selecting the low capillary pressure portion to have a capillary pressure higher than that of the fabric being treated.

In an ASRA comprised of two or more layers differing in capillary pressure, the pattern of capillary pressure change can be characterized as "stepped". Through the thickness of the ASRA there is a sharp change or step in capillary pressure at the layer interfaces. It will be appreciated that the ASRA herein need not comprise multiple distinct layers, but rather can comprise a single layer structure with a relatively continuous capillary size gradient through its thickness.

The ASRA can be made from a variety of materials including fibrous absorbents and foams. Useful fibrous absorbents include nonwoven fabrics (carded, hydroentangled, thermal bonded, latex bonded, meltblown, spun, etc.), thermal bonded airlaid nonwovens ("TBAL"), latex bonded airlaid nonwovens ("LBAL"), multi-bonded airlaid nonwovens ("MBAL" combined latex and thermal bonded), wet laid paper, woven fabrics, knitted fabrics or combination of materials (i.e., top layer of a carded nonwoven, and a bottom layer of wet laid paper). These fibrous absorbents can be manufactured using a wide variety of fibers including both natural and synthetic fibers. Useful fibers include wood pulp, rayon, cotton, cotton linters, polyester, polyethylene, polypropylene, acrylic, nylon, multi-component binder fibers, etc. Multiple fiber types can be blended together to make useful materials. Useful foam materials include polyurethane foams and high internal phase emulsion foams. The critical factor is to have a difference in capillary pressure within the thickness of the ASRA. A broad range of fiber sizes can be employed. A typical, but non-limiting range of diameters is from about 0.5 micrometers to about 60 micrometers. For meltblown, the preferred fibers are less than about 10 micrometers. Typical spun-bond and synthetic staple fibers range in diameter from about 14 to about 60 micrometers. In general, one selects smaller diameter fibers for the high capillary pressure layer and higher diameters for low capillary pressure. Fiber length can depend on the forming process that is being used and the desired capillary pressure. Spun-bonds comprise a substantially continuous fiber. For air-laid fibers, 4-6 mm is typical. For carded fibers the range is typically 25-100 mm. In addition, it has now been found that enriching the upper layer in bicomponent fibers decreases linting during use. Cleaning can also be enhanced by making the top layer rich in synthetic (e.g., bicomponent) fibers due to their lipophilic nature which aids in the removal of oily stains from the fabric article being treated.

Absorbent gelling materials ("AGM") such as those sometimes referred to in the diaper art as 'supersorbers' can be added to either or both layers of the receiver or as a discrete layer between the fiber layers or on the back of the bottom layer of the ASRA. Functionally, the AGM provides additional liquid absorption capacity and serves to drain the capillaries in the ASRA structure which helps to maintain the capillary pressure gradient as liquid is absorbed.

Another type of absorbent useful herein comprises Functional Absorbent Materials ("FAM's") which are in the form of water-absorbent foams having a controlled capillary size. The physical structure and resulting high capillarity of FAM-type foams provide very effective water absorption, while at the same time the chemical composition of the FAM typically renders it highly lipophilic. Thus, the FAM can essentially provide both hydrophilicity and lipophilicity simultaneously. (FAM foams can be treated to render them hydrophilic. Both the hydrophobic or hydrophilic FAM can be used herein.)

The acquisition and absorbency of the FAM with respect to the liquid cleaning compositions herein is superior to most other types of absorbent materials. For example, the FAM has a capacity of about 6 g ($H_2O$) per gram of foam at a suction pressure of 100 cm of water. By contrast, cellulose wood fiber structures have substantially no capacity above about 80 cm of water. Since, in the present process the volume of liquid cleaning composition used is relatively low (a few milliliters is typical) the amount of FAM used can be small. This means that the pad of FAM which underlays the stained area of fabric can be quite thin and still be effective.

The manufacture of FAM-type foams for use as the ASRA herein forms no part of the present invention. The manufacture of FAM foam is very extensively described in the patent literature; see, for example: U.S. Pat. No. 5,260,345 to DesMarais, Stone, Thompson, Young, LaVon and Dyer, issued Nov. 9, 1993; U.S. Pat. No. 5,268,224 to DesMarais, Stone, Thompson, Young, LaVon and Dyer, issued Dec. 7, 1993; U.S. Pat. No. 5,147,345 to Young, LaVon and Taylor, issued Sep. 15, 1992 and companion patent U.S. Pat. No. 5,318,554 issued Jun. 7, 1994; U.S. Pat. No. 5,149,720 to DesMarais, Dick and Shiveley, issued Sep. 22, 1992 and companion patents U.S. Pat. No. 5,198,472, issued Mar. 30, 1993 and U.S. Pat. No. 5,250,576 issued Oct. 5, 1993; U.S. Pat. No. 5,352,711 to DesMarais, issued Oct. 4, 1994; PCT application 93/04115 published Mar. 4, 1993, and U.S. Pat. No. 5,292,777 to DesMarais and Stone, issued Mar. 8, 1994; U.S. Pat. No. 5,387,207 to Dyer, DesMarais, LaVon, Stone, Taylor and Young, issued Feb. 7, 1995; U.S. Pat. No. 5,500,451 to Goldman and Scheibel, issued Mar. 19, 1996; and U.S. Pat. No. 5,550,167 to DesMarais, issued Aug. 27, 1996, all incorporated herein by reference.

Absorbents made of FAM foam can be used in either of two ways. In one mode, the uncompressed foam is used. Uncompressed FAM pads having a thickness in the range of about 0.3 mm to about 15 mm are useful. In another mode, the FAM foam can be used in a compressed state which swells as liquid cleaner with its load of stain material is imbibed. Compressed FAM foams having thicknesses in the range of about 0.02 inches (0.5 mm) to about 0.185 inches (4.7 mm) are suitable herein. The preparation of FAM foam (also sometimes referred to in the literature as "HIPE", i.e., high internal phase emulsion) is described in the patents cited hereinabove, the disclosures of which have been incorporated herein by reference.

In light of the foregoing considerations, the ASRA herein can be defined as an absorbent structure which has a capillary pressure difference through its thickness (Z-direction). In a typical, but non-limiting mode, this can be achieved by having relatively larger capillaries (for example 50-100 micrometers radius) in the upper, liquid-receiving portion of the ASRA which is placed in contact with the fabric article being treated. The lower, liquid-storage portion having relatively smaller capillaries (for example 5-30 micrometers radius). Irrespective of the size employed, it is desirable that the difference in average capillary pressure between the two layers be large enough that the overlap in capillary pressure range between the two layers is minimized.

Basis Weight

The basis weight of the ASRA can vary depending on the amount of cleaning solution which must be absorbed. A preferred 127 mm×127 mm receiver absorbs about 10-50 grams of water. Since very little liquid is used in the typical stain removal process, much less capacity is actually required. A typical TBAL ASRA pad weighs about 4-6 grams. A useful range is therefore about 1 gram to about 7 grams. A variety of sizes can be used, e.g., 90 mm×140 mm.

Size and Thickness

The preferred size of the ASRA is about 127 mm×127 mm, but other sizes can be used, e.g., 90 mm×140 mm. The shape can also be varied. The overall thickness of the preferred ASRA is about 3 mm (120 mils) but can be varied widely. The low end may be limited by the desire to provide absorbency impression. A reasonable range is 25 mils to 200 mils.

Other ASRA Design Considerations

The ASRA is preferably dust and lint free. Some materials are naturally dust and lint free (synthetic nonwoven fabrics). Some, generally cellulose containing materials, can be dusty because not all the fibers are bonded. Dust and lint can be reduced by bonding substantially all the fibers which reside on or near the surface of the ASRA which contacts the fabric article being treated. This can be accomplished by applying resins such as latex, starch, polyvinyl alcohol or the like. Cold or hot crimping, sonic bonding, heat bonding and/or stitching may also be used along all edges of the receiver to further reduce Tinting tendency.

The ASRA is generally sufficiently robust that it can be used as-is. However, in order to prevent strike-through of the liquid onto the table top or other treatment surface selected by the user, it is preferred to affix a liquid-impermeable barrier sheet to the bottom-most surface of the lower layer. This backing sheet also improves the integrity of the overall article. The bottom-most layer can be extrusion coated with an 0.5-2.0 mil, preferably 1.0 mil, layer of polyethylene or polypropylene film using conventional procedures. A film layer could also be adhesively or thermally laminated to the bottom layer. The film layer is designed to be a pinhole-free barrier to prevent any undesired leakage of the cleaning composition beyond the receiver. This backing sheet can be printed with usage instruction, embossed and/or decorated, according to the desires of the formulator. The ASRA is intended for use outside the dryer. However, since the receiver may inadvertently be placed in the dryer and subjected to high temperatures, it is preferred that the backing sheet be made of a heat resistant film such as polypropylene or nylon.

White is the preferred color for the ASRA as it allows the user to observe transfer of the stain from the fabric to the receiver. However, there is no functional limit to the choice of color. The backing sheet can optionally be a contrasting color.

The ASRA can also be embossed with any desired pattern or logo.

Manufacture

A typical, but non-limiting, embodiment of the ASRA herein is a TBAL material which consists of an upper, low capillary pressure layer which is placed in liquid communication contact with the fabric article being treated and a bottom high capillary pressure layer. The ASRA can be conveniently manufactured using procedures known in the art for manufacturing TBAL materials; see U.S. Pat. No. 4,640,810. As an overall proposition, TBAL manufacturing processes typically comprise laying-down a web of absorbent fibers, such as relatively short (2-4 mm) wood pulp fibers, in which are commingled relatively long (4-6 mm) bi-component fibers. The sheath of the bicomponent fiber melts with the application of heat to achieve thermal bonding. The bi-component fibers intermingled throughout the wood pulp fibers thereby act to 'glue' the entire mat together. Both layers in one embodiment of the ASRA herein can be a homogeneous blend of wood pulp fibers and bi-component thermal bonding fibers. In a more preferred embodiment, the top layer is 100% concentric bi-component fiber comprising 50:50 (wt.) polyethylene (PE) and polypropylene (PP) comprising a PP core enrobed in an outer sheath of PE. The gradient is achieved by providing a higher proportion of bicomponent bonding fibers in the top layer compared to the bottom layer. Using a TBAL process as described in U.S. Pat. No. 4,640,810, the top, low capillary pressure layer is formed by a first forming station from 100% bicomponent fiber (AL-Thermal-C, 1.7 dtex, 6 mm long available from Danaklon a/s). Basis weight of this all-bicomponent top layer is approximately 30 gsm (grams/meter$^2$). The bottom, high capillary pressure layer is formed upon the top layer by second and third forming stations from a fiber blend consisting of approximately 72% wood pulp (Flint River Fluff available from Weyerhaeuser Co.) and approximately 28% bi-component binder fiber. Basis weight of this bottom layer is approximately 270 gsm. Each of the second and third forming station deposits approximately half of the total weight of the bottom layer. The two layers are then calendered to provide a final combined thickness of approximately 3 mm. Subsequently, a 1.0 mil coating of polypropylene is extrusion coated onto the exposed surface of the bottom layer. Individual receivers are cut to 127 mm×127 mm size. In one optional mode, since the material will be wound into a roll before applying the back sheet, a binder (e.g., latex—Airflex 124 available from Air Products) can be applied to the exposed surface of the lower layer prior to thermal bonding to prevent transfer of dust and lint to the top all-bicomponent layer. Alternatively, a non-linting sheet can be placed on the ASRA during roll-up to prevent Tinting due to contact between the surfaces.

Usage Conditions

The ASRA herein is intended to be made so inexpensively that it can be discarded after a single use. However, the structures are sufficiently robust that multiple re-uses are possible. In any event, the user should preferably position the article such that "clean" areas are positioned under the stained areas of the fabric article being treated in order to avoid release of old stains from the ASRA back onto the fabric.

Preferred Pre-Treating Compositions

The chemical compositions which are used to pre-treat localized stains comprise ingredients which are safe and effective for their intended use. Since the process herein does not involve an aqueous rinse step, the compositions employ ingredients which do not leave undesirable residues on fabrics when employed in the manner disclosed herein. While conventional laundry detergents are typically formulated to provide good cleaning on cotton and cotton/polyester blend fabrics, the compositions herein must be formulated to also safely and effectively pre-treat fabrics such as wool, silk, rayon, rayon acetate, and the like.

In addition, the compositions herein comprise ingredients which are specially selected and formulated to minimize dye removal or migration from the stain site of fugitive, unfixed dye from the fabric articles being cleaned. In this regard, it is recognized that the solvents typically used in immersion dry cleaning processes can remove some portion of certain types of dyes from certain types of fabrics. However, such removal is tolerable in immersion processes since the dye is removed relatively uniformly across the surface of the fabric. In contrast, it has now been determined that high concentrations of certain types of cleaning ingredients at specific sites on fabric surfaces can result in unacceptable localized dye removal. The preferred compositions herein are formulated to minimize or avoid this problem.

In addition to the foregoing considerations, the compositions used herein are preferably formulated such that they are easily dispensed and not so adhesive in nature that they render the spot-cleaning device unhandy or difficult to use. However, and while not intending to be limiting of the present invention, the preferred compositions disclosed herein afford a spot-cleaning process which is both effective and aesthetically pleasing when used with a device according to this invention.

Surfactants

Nonionics such as the ethoxylated $C_{10}$-$C_{16}$ alcohols, e.g., NEODOL 23-6.5, can also be used in the compositions. The alkyl sulfate surfactants which may be used herein as cleaners and to stabilize aqueous cleaning compositions are the $C_8$-$C_{18}$ primary ("AS"; preferred $C_{10}$-$C_{14}$, sodium salts), as well as branched-chain and random $C_{10}$-$C_{20}$ alkyl sulfates, and $C_{10}$-$C_{18}$ secondary (2,3) alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, as well as unsaturated sulfates such as oleyl sulfate. Alkyl ethoxy sulfate (AES) surfactants used herein are conventionally depicted as having the formula $R(EO)_xSO_3Z$, wherein R is $C_{10}$-$C_{16}$ alkyl, EO is —$CH_2CH_2$—O—, x is 1-10 and can include mixtures which are conventionally reported as averages, e.g., $(EO)_{2.5}$, $(EO)_{6.5}$ and the like, and Z is a cation such as sodium ammonium or magnesium (MgAES). The $C_{12}$-$C_{16}$ dimethyl amine oxide surfactants can also be used. A preferred mixture comprises $MgAE_1S/MgAE_{6.5}S/C_{12}$ dimethyl amine oxide at a weight ratio of about 1:1:1. A more preferred mixture comprises $MgAE_1S/C_{12}$ dimethyl amine oxide at a weight ratio of about 10:1. Other surfactants which improve phase stability and which optionally can be used herein include the polyhydroxy fatty acid amides, e.g., $C_{12}$-$C_{14}$ N-methyl glucamide. AS stabilized compositions preferably comprise 0.1%-0.5%, by weight, of the compositions herein. MgAES and amine oxides, if used, can comprise 0.01%-2%, by weight, of the compositions. The other surfactants can be used at similar levels.

Having due regard to the foregoing considerations, the following illustrates the various other ingredients which can be used in the compositions herein, but is not intended to be limiting thereof.

Aqueous Compositions (a) Solvent—The compositions herein may comprise from about 0% to about 6%, by weight, of BPP solvent.

(b) Water—The compositions herein may comprise from about 94%, preferably from about 95.5% to about 99%, or even 99.9%, by weight, of water.

(c) Surfactant—The preferred compositions herein may comprise from about 0.05% to about 2%, by weight, of surfactants such as ethoxylated alcohols or alkyl phenols, alkyl sulfates or MgAES, $NH_4$AES, amine oxides, and mixtures thereof. Typically, the weight ratio of BPP solvent:surfactant(s) is in the range of from about 10:1 to about 1:1. A preferred composition comprises 2% BPP/0.3% $MgAE_1S$/0.03% $C_{12}$ dimethyl amine oxide.

(d) Optionals—The compositions herein may comprise minor amounts of various optional ingredients, including perfumes, preservatives, and the like. If used, such optional ingredients will typically comprise from about 0.05% to about 2%, by weight, of the compositions, having due regard for residues on the cleaned fabric articles.

Organic Solvent

The preferred cleaning solvent herein is butoxy propoxy propanol (BPP) which is available in commercial quantities as a mixture of isomers in about equal amounts. The isomers, and mixtures thereof, are useful herein. The isomer structures are as follows:

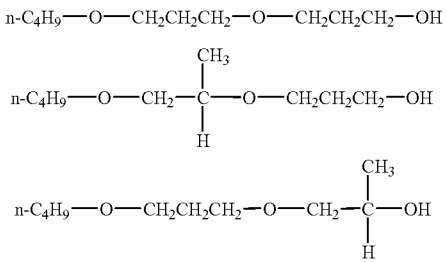

While the liquid cleaning compositions herein function quite well with only the BPP, water and stabilizing surfactant, they may also optionally contain other ingredients to further enhance their stability. Hydrotropes such as sodium toluene sulfonate and sodium cumene sulfonate, short-chain alcohols such as ethanol and isopropanol, and the like, can be present in the compositions. If used, such ingredients will typically comprise from about 0.05% to about 5%, by weight, of the stabilized compositions herein. Non-aqueous (less than 50% water) compositions which optionally can be used in the pre-spotting step can comprise the same organic solvents.

Other Optionals

In addition to the water, the preferred BPP solvent and the surfactants disclosed above, the compositions herein may comprise various optional ingredients, such as perfumes, preservatives, brighteners, salts for viscosity control, pH adjusters or buffers, and the like.

EXAMPLE I

Examples of preferred, high water content pre-treating compositions for use in the localized stain removal step herein are as follows. The compositions are listed as "nonionic" or "anionic", depending on the type of surfactant used therein. These compositions are used in the manner disclosed in Example II hereinafter.

| Ingredient | Nonionic (%) | Anionic (%) |
|---|---|---|
| Butoxypropoxypropanol (BPP) | 2.00 | 2.00 |
| NEODOL 23 6.5 | 0.250 | — |
| $NH_4$Coconut $E_1S$* | — | 0.285 |
| Dodecyldimethylamine oxide | — | 0.031 |
| $MgCl_2$ | — | 0.018 |
| $MgSO_4$ | — | 0.019 |
| Hydrotrope, perfume, other minors | — | 0.101 |
| KATHON preservative | 0.0003 | 0.0003 |
| Water | 97.750 | 97.547 |

*Ammonium salt of $C_{12}$-$C_{14}$ (coconut alkyl) ethoxy (EO-1) sulfate.

EXAMPLE II

A liquid cleaning/refreshment composition for use in the processes and kits of the present invention is prepared, as follows.

| Ingredient | % (wt.) |
|---|---|
| Water | 99.3 |
| Emulsifier (TWEEN 20)* | 0.3 |
| Perfume | 0.4 |

*Polyoxyethylene (20) sorbitan monolaurate available from ICI Surfactants.

230 Grams of the product is applied to six (6) 40 cm×40 cm carrier sheets of non-woven fabric, preferably HYDRASPUN®. In simple, yet effective, mode, the carrier sheets are placed in a pouch and saturated with the product. The capillary action of the substrate and, optionally, manipulation and/or laying the pouch on its side, causes the product to wick throughout the sheets. Preferably, the sheets are of a type, size and absorbency that they are not "dripping" wet from the liquid. The pouch is sealed so that the liquid composition is stable to storage until use.

Step 1.

A fabric article to be cleaned and refreshed is selected. Localized stained areas of the fabric article are situated over an absorbent TBAL stain receiver or other ASRA as disclosed herein and are treated by directly applying about 0.5-5 mls (depending on the size of the stain) of the liquid pre-treating composition of Example I, which is gently worked into the fabric using the device herein. The treated stains are padded with dry paper toweling. In an alternate mode, the refreshment product is releasably absorbed on a carrier sheet and applied to the stains.

Step 2.

Following the pre-spotting step, the fabric article is placed into a conventional clothes dryer together with the sheets (which are removed from the storage pouch and unfolded) releasably containing the liquid cleaning/refreshment composition of Example IT. The dryer is operated in standard fashion for 10-60 minutes at a high heat setting (an air temperature range of about 140-170° F.; 60-76.7° C.). After the tumbling action of the dryer ceases, the cleaned and refreshed fabric article is removed from the dryer. The used carrier sheets are discarded.

EXAMPLE III

Additional, high water content cleaning/refreshment compositions for use in the dryer step of the processes herein are as follows. The compositions are used in the manner disclosed hereinabove to clean and refresh fabrics.

| Components | Percent | Range (%) | Function |
|---|---|---|---|
| Water De-ionized | 98.8997 | 97-99.9 | Vapor Phase Cleaning |
| TWEEN 20 | 0.50 | 0.5-1.0 | Wetting Agent, Emulsifier for Perfume |
| Perfume | 0.50 | 0.1-1.50 | Scent, Aesthetics |
| KATHON CG* | 0.0003 | 0.0001-0.0030 | Anti-bacterial |
| Sodium Benzoate* | 0.10 | 0.05-1.0 | Anti-fungal |

*Optional preservative ingredients.

200-1,000 grams, preferably about 230 grams, of the liquid cleaning/refreshment composition is absorbed into six (6) 40 cm×40 cm HYDRASPUN® carrier sheets (the sheets are preferably not "dripping" wet). The sheets are used in the foregoing manner to clean and refresh fabric articles in a hot air clothes dryer.

EXAMPLE IV

A liquid pre-treating composition is formulated by admixing the following ingredients.

| Ingredient | % (wt.) |
|---|---|
| BPP | 4.0 |
| $C_{12}$-$C_{14}$ AS, Na salt | 0.25 |
| Water and minors* | Balance |

*Includes preservatives such as KATHON ® at levels of 0.00001%-1%, by weight.

The fabric article to be treated is laid flat on an absorbent TBAL stain receiver sheet or any of the other ASRA's disclosed herein, and 0.5 ml-4 ml of the composition is applied directly to the stain and worked in using the cleaning device.

Other useful compositions which can be used in this step are as follows:

| Ingredient | Percent (wt.) | (Range; wt.) |
|---|---|---|
| BPP | 4.0 | 0.1-4.0% |
| $C_{12}C_{14}$ AS | 0.4 | 0.1-0.5% |
| Nonionic Surfactant (optional)* | 0.1 | 0-0.5% |
| Water (distilled or deionized) | Balance | 95-99.8% |
| Target pH = 7.0 | | |

*The optional nonionic surfactants in the compositions herein are preferably $C_{12}$-$C_{14}$ N-methyl glucamides or ethoxylated $C_{12}$-$C_{16}$ *alcohols (EG 1-10).*

The foregoing illustrates pre-spotting compositions using the AS surfactant. Improved cleaning performance can be achieved using MgAES and amine oxide surfactants, although possibly with some reduction in phase stability. Thus, aqueous compositions with approximately 2-3% BPP can be stabilized using MgAES surfactants. However, for compositions containing 4%, and higher, BPP, the formulator may wish to include AS surfactant. The amount and blend of surfactants will depend on the degree of temperature-dependent phase stability desired by the formulator. Amine oxide surfactants such as dimethyl dodecyl amine oxide can also be used in the compositions.

The pre-spotted fabric articles are then placed in a drying device together with one or more of the carrier sheets which releasably contain about 200-1,000 grams of a cleaning/refreshment composition according to any of the Examples herein. The dryer is started and the fabric articles and carrier sheets are tumbled for a period of 10-60 minutes at a dryer air temperature in the range from about 40° C. to about 70° C. During this time, the carrier sheets come into close contact with the fabric articles. The water vapors and malodorous, volatile materials are vented from the dryer by a fan as in a conventional clothes dryer. After the machine cycle is complete, the fabric articles and carrier sheets are removed from the dryer, and the spent carrier sheets are discarded. The fabric articles are cleaned and refreshed.

With respect to the wrinkle-removing function of the in-dryer step of the process and the compositions herein, it will be appreciated that wrinkling can be affected by the type of fabric, the fabric weave, fabric finishes, and the like. For fabrics which tend to wrinkle, it is preferred not to overload the dryer. Thus, for a dryer with, for example, an operational capacity of up to about 3.5 to 7.0 cubic feet (99,110 to 198,200 cubic centimeters), it may be best to process up to only about 35% to about 40% of the dryer capacity, to further minimize wrinkling of the fabric articles.

EXAMPLE V

A low residue liquid cleaning/refreshment composition for use in the processes and kits of the present invention is prepared, as follows.

| Ingredient | % (wt.) |
|---|---|
| Emulsifier (TWEEN 20)* | 0.5 |
| Perfume | 0.5 |
| KATHON ®** | 0.0003 |
| Sodium Benzoate | 0.1 |
| Water | Balance |

*Polyoxyethylene (20) sorbitan monolaurate available from ICI Surfactants.
**Preservative A carrier sheet of HYDRASPUN® is prepared. The carrier sheet is covered on both sides with a topsheet and a bottomsheet of 8 mil (0.2 mm) Reemay fabric coversheet material of the type described hereinabove. The coversheet (i.e., both topsheet and bottomsheet) are bonded to the carrier sheet by a Vertrod® or other standard heat sealer device, thereby bonding the laminate structure together around the entire periphery of the carrier sheet. The edges of the carrier sheet around its periphery are intercalated between the topsheet and bottomsheet by the bond. The width of the bond is kept to a minimum and is about 0.25 in (6.4 mm).

The bonded laminate structure thus prepared is rolled somewhat loosely around a cylindrical void into a generally tubular shape of about 40 cm length and a diameter of about 2-3 cm. The rolled article is then folded to half its length at about its mid-point by means of a thrusting blade which also serves to insert the article into a retaining pouch. It is observed that, with the rolling method herein, essentially no severely sharp creases are formed, and the final doubling of the rolled tube is under such stress that only in the very center of the bend are a few sharper creases formed. The result is that permanent refolding along crease lines is essentially avoided, and release of the cleaning/refreshment composition from the article in-use is optimized.

Any plastic or flexible pouch which does not leak is suitable for use to contain the carrier sheets and liquid cleaning/refreshment compositions disclosed herein. For example, a foil laminated pouch of the type used in the food service industry can be employed. Such pouches are well-known in the industry and are made from materials which do not absorb food flavors. In like manner, the formulator herein may wish to avoid absorption of the perfume used in the cleaning/refreshment composition by the pouch. Various pouches are useful herein and are commercially available on a routine basis. Thus, the pouch containing the rolled/folded carrier sheets herein has overall dimensions of about 8.5 cm×22 cm. 230 grams of the liquid cleaning/refreshment composition are poured onto the carrier sheets within the pouch and allowed to absorb into it for a minimum of 30 minutes, preferably for at least about 4 hours. The pouch is sealed immediately after the liquid product is introduced into the pouch and stored until time-of-use.

While the process and components thereof have been described herein both broadly and in detail, modifications thereof which meet the foregoing considerations fall within the spirit and scope of the present invention. Kits according to the present invention conveniently contain 1 to about 20 of the carrier sheets, liquid cleaning/refreshment composition, optionally from about 1 to about 6 of the sheet-form ASRA's and bottled portions (typically about 10 ml to about 100 ml) of the pre-treating composition. However, larger or smaller quantities of the carrier sheets, receivers and/or the pre-treating compositions can be provided. Kits comprising one or more ASRA's and a portion, e.g., 5-200 mls, of cleaning composition are also provided herein.

What is claimed is:

1. A bagless kit for dry cleaning fabrics comprising one or more carrier sheets that releasably comprise from about 200 grams to about 1000 grams of a liquid cleaning/refreshment composition such that when fabrics are exposed to said liquid cleaning/refreshment composition within a heating vessel, in the absence of a bag, the fabrics are cleaned, wherein said one or more carrier sheets are hydroentangled material.

2. The kit according to claim 1 wherein said fabric are exposed to said liquid cleaning/refreshment composition in a heating vessel.

3. A kit according to claim 1 further comprising one or more Absorbent Stain Receiver Articles.

4. A kit according to claim 3 wherein said one or more Absorbent Stain Receiver Articles is selected from the group consisting of TBAL, LBAL, MBAL, FAM and mixtures thereof.

5. A kit according to claim 1 further comprising a pre-treating composition.

6. A kit according to claim 5 wherein the pre-treating composition comprises butoxy propoxy propanol.

7. A kit according to claim 1 wherein the one or more carrier sheets are supplied in a pouch which is substantially water tight and the carrier sheets are pre-saturated with the liquid cleaning/refreshment composition.

8. A kit according to claim 1, wherein the liquid cleaning/refreshment composition comprises from about 90% to about 99.5% by weight water and from about 10% to about 0.5% by weight of materials selected from the group consisting of perfumes, emulsifiers, surfactants, solvents, preservatives and mixtures thereof.

9. A kit according to claim 1 wherein the one or more carrier sheets have an aggregate surface area of from about 250 $in^2$ (1613 $cm^2$) to about 1,000 $in^2$ (6452 $cm^2$).

10. A method for cleaning fabrics in need of cleaning comprising:

a) placing the fabrics in a heating vessel;

b) placing a carrier sheet that releasably comprises from about 200 grams to about 1000 grams of a liquid cleaning/refreshment composition, such that when the fabrics are exposed to said liquid cleaning/refreshment composition the fabrics are cleaned, into the heating vessel, wherein said carrier sheet is a hydroentangled material; and c) operating the heating vessel, in the absence of a bag, such that the carrier sheet releases the liquid cleaning/refreshment composition in the form of a liquid vapor within the heating vessel.

11. A method for dry cleaning fabrics in a heating vessel without adding wrinkles to the fabric articles comprising:

a) placing the fabrics in a heating vessel;

b) placing a carrier sheet that releasably comprises from about 200 grams to about 1000 grams of a liquid cleaning/refreshment composition, such that when the fabrics are exposed to said liquid cleaning/refreshment composition the fabrics are cleaned, into the heating vessel, wherein said carrier sheet is a hydroentangled material; and c) operating the heating vessel, in the absence of a bag, such that the carrier sheet releases the liquid cleaning/refreshment composition in the form of a liquid vapor within the heating vessel.

* * * * *